United States Patent [19]

Massey

[11] 4,274,612

[45] Jun. 23, 1981

[54] MULTIPLE DIAMETER WIRE BUNDLE SUPPORT

[75] Inventor: Dalton L. Massey, Benbrook, Tex.

[73] Assignee: The United States of America as represented by the Secretary of the Air Force, Washington, D.C.

[21] Appl. No.: 48,874

[22] Filed: Jun. 15, 1979

[51] Int. Cl.[3] ..... B65D 63/00; F16L 3/08

[52] U.S. Cl. ..... 248/74 PB; 24/16 PB; 24/17 AP

[58] Field of Search ..... 248/74 PB, 74, B, 74 A; 24/16 PB, 17 AP

[56] References Cited

U.S. PATENT DOCUMENTS

| | | | |
|---|---|---|---|
| 2,896,889 | 7/1959 | Hershberger et al. | 248/74 PB |
| 3,050,578 | 8/1962 | Huebner | 24/17 AP |
| 3,054,585 | 9/1962 | Roberts et al. | 24/16 PB |
| 3,099,054 | 7/1963 | Spiro | 24/16 PB |
| 3,118,644 | 1/1964 | Wernig | 248/74 PB |
| 3,169,004 | 2/1965 | Rapata | 248/74 PB |
| 3,169,005 | 2/1965 | Wallach | 248/74 PB |
| 3,473,768 | 10/1969 | Piasecki | 24/16 PB |
| 3,483,285 | 12/1969 | Foley | 24/16 PB |

FOREIGN PATENT DOCUMENTS

| | | | |
|---|---|---|---|
| 1080617 | 6/1954 | France | 24/16 PB |
| 692387 | 7/1965 | Italy | 248/74 PB |

*Primary Examiner*—Victor N. Sakran

*Attorney, Agent, or Firm*—Donald J. Singer; Arsen Tashjian

[57] ABSTRACT

A clamp fabricated of a springy material having two curved arms attached at a common anchoring point with a series of equally spaced holes along the length of the arms. A first pin extending inwardly and located on the outer extremity of the first of the arms is adapted to engage one of the holes in the second arm, while a second pin extending outwardly and located on the outer extremity of the second of the arms is adapted to engage one of the holes in the first arm. The arms may be of any convenient size and length to roughly define curved concentric loops for accommodating the required number and diameter of wires therein.

2 Claims, 3 Drawing Figures

MULTIPLE DIAMETER WIRE BUNDLE SUPPORT

STATEMENT OF GOVERNMENT INTEREST

The invention described herein may be manufactured and used by or for the Government for governmental purposes without the payment of any royalty thereon.

BACKGROUND OF THE INVENTION

This invention relates to a support for accommodating several different wire bundle diameters and, more particularly, the invention is concerned with providing a bundle support clamp which can be installed during subassembly buildup with no tools needed for clamping the wire bundle in place. The support can be opened by unlocking for removing the wire bundle or to add more wires.

Heretofore, many different devices have been used for retaining wires to cables in position on a supporting structure. However, in most cases, one or more tools are required in order to install the wire bundle in the clamp. Also, may times the clamps are arranged so as to be suitable for use with only one size bundle of wires or the clamps can be used only once because they cannot be opened and reclosed for a second use.

It would be most desirable to provide a clamp wherein one size would accommodate several different bundle diameters and which could be installed during subassembly buildup rather than at wire bundle installation time. Also, the clamp should be reusable and compatible with the ambient temperature requirements of all military aircraft. When installation of the clamp is required in congested areas, it would be much more convenient if the bundle could be installed in the clamp after the clamp has been attached to the subassembly structure. The hereinafter described multiple diameter wire bundle support does overcome the disadvantages associated with the presently available retainers while at the same time providing the needed features for accomplishing the desired results.

SUMMARY OF THE INVENTION

The present invention is concerned with providing a wire bundle support wherein one size will accommodate a range of different diameter wire bundles. The support can be installed during structural subassembly and no tools are required to install the wire bundle since it can be easily locked together once the wire bundle is in place. The wire bundle support includes two outwardly extending arms attached to each other at their inner ends and having pin members attached to their outer ends. Each of the arms is provided with a series of holes equally spaced along the length thereof for receiving the pin attached to the end of the other arm. The arms are wrapped around the wire bundle and the pins on each of the arms are inserted in the appropriate hole to form a clamp for holding the wires in the bundle firmly in position.

Accordingly, it is an object of the invention to provide a multiple diameter wire bundle support which is capable of accommodating several different bundle diameters.

Another object of the invention is to provide a multiple diameter wire bundle support which can be installed during subassembly buildup rather than at wire bundle installation time.

Still another object of the invention is to provide a multiple diameter wire bundle support wherein no tools are required to install the wire bundle. Because of the material of fabrication and the unique preshaped condition of the support, the wire bundle is locked into place after insertion.

A further object of the invention is to provide a multiple diameter wire bundle support which is capable of being unlocked and opened in order to add or remove wires in the bundle.

A still further object of the invention is to provide a multiple diameter wire bundle support which is fabricated of molded Kynar, spring steel, beryllium copper or some other material having the required physical properties of being conditioned to retain a preshaped configuration.

These and other objects, features and advantages will become more apparent after considering the following detailed description taken in conjunction with the annexed drawings and appended claims.

DESCRIPTION OF A PREFERRED EMBODIMENT

Figure 1:
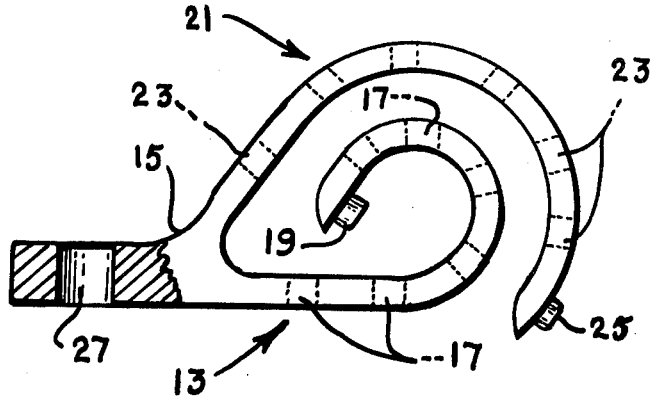
FIG. 1 is a side view of the multiple diameter wire bundle support according to the invention in its fabricated shape showing the locking pins attached to the outer ends of the arms.
Figure 2:
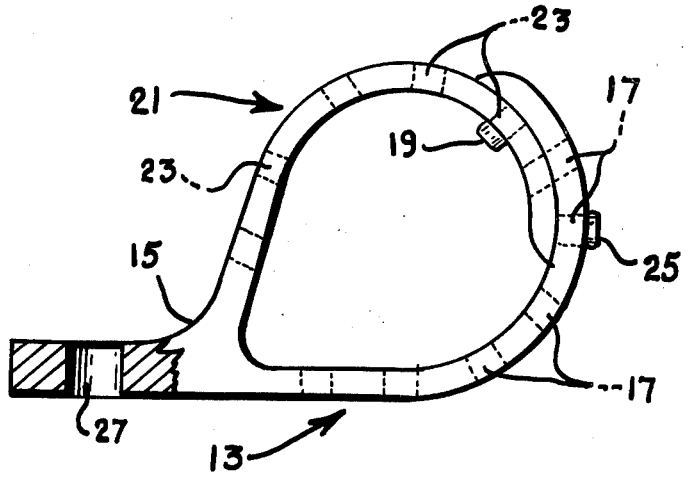
FIG. 2 is a side view of the support apparatus of FIG. 1 in its locked position for maximum diameter accommodation of a bundle of wires (not shown)
Figure 3:
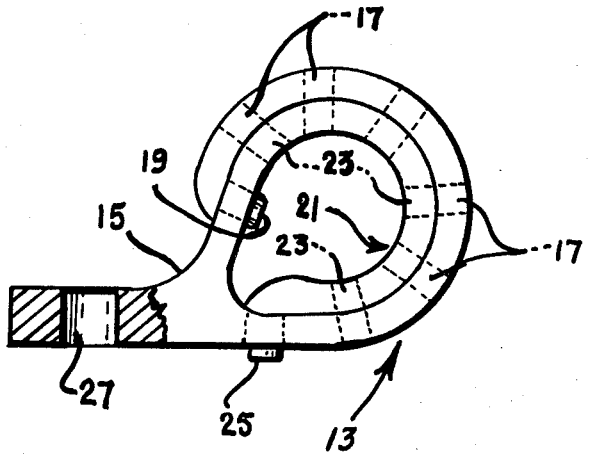
FIG. 3 is a side view of the support apparatus of FIG. 1 in its locked position for minimum diameter accommodation of a bundle of wires (not shown).

Referring now to the drawings in which like reference numerals refer to like structural elements in the several views, there is shown a multiple diameter wire bundle support according to the invention including a first arm 13 extending outwardly from an anchor portion 15. The first arm 13 is provided with a series of equally spaced holes 17 along its length and includes an inwardly disposed pin member 19 positioned on the outer end thereof. The first arm 13 curves inwardly to form a spiral in the counterclockwise direction of relatively small diameter. A second arm 21 extends outwardly from the same anchor portion 15 and includes a series of equally spaced holes 23 along its length. An outwardly disposed pin member 25 is positioned on the outer end of the second arm 21 which curves inwardly less than the first arm 13 to form a relatively large spiral in the clockwise direction around the outside of the first arm 13. The pin member 19 on the first arm 13 is adapted to fit into one of the holes 23 in the second arm 21 and the pin member 25 on the second arm 21 is adapted to fit into one of the holes 17 in the first arm 13.

In operation, the first and second arms 13 and 21 are carefully uncurled or opened so that a bundle of wires (not shown) can be inserted between them. The second arm 21 is then wrapped tightly around the bundle with the pin member 25 pointing outwardly and pin member 25 is inserted in one of the holes 17 in the first arm 13. The first arm 13 is then wrapped around the second arm 21 amd the pin member 19 pointing inwardly is inserted in one of the holes 23 in the second arm 21. Since the holes 17 and 23 in the first and second arms 13 and 21 are all equally spaced, the pin members 19 and 25 will automatically be in alignment with the holes 17 and 23 when the above-described procedure is followed.

Thus it can be seen that the shape of the support apparatus is such that, with the wire bundle installed, the spinginess in the material and the shape of the arms 13 and 21 causes them to lock together. Also, it should be noted that the number and spacing of the holes 17 and 23 as well as the size and length of the arms 13 and 21 will determine the diameters that may be accommodated by any one support apparatus.

Although the invention has been illustrated in the foregoing specification in terms of a preferred embodiment thereof, the invention is not limited to this embodiment or to the particular configuration shown and described. It will be apparent to those skilled in the art that certain changes, modifications and substitutions can be made with respect to the shape and positioning of the elements without departing from the true spirit and scope of the appended claims. It can be seen that the invention may be used to support tubing, conduit, fuel lines, etc. as well as wires and cables. Although especially suited for aircraft, the support apparatus can be used in any device where its installation at the subassembly level and its capability to accommodate different diameters will enhance final assembly.

Having thus set forth the nature of my invention, what I claim and desire to secure by Letters Patent of the United States is:

1. A multiple diameter wire bundle support for fixedly retaining various numbers and diameters of wires and the like in position on a subassembly structure comprising a first arm extending outwardly from a common anchor point, a second arm extending outwardly from the same common anchor point, a first pin member fixedly attached near the outer end of said first arm and extending inwardly therefrom, a second pin member fixedly attached near the outer end of said second arm and extending outwardly therefrom, the inner ends of said first and second arms meeting to form a common anchor portion, a series of equally spaced holes along the length of said first and second arms, and an opening in the anchor portion for attaching the support to a subassembly structure, the outer ends of said first and second arms being adjustably attachable to one another by the insertion of said first pin member into one of the holes in said second arm and the insertion of said second pin member into one of the holes in said first arm, thereby forming a substantially circular enclosure for housing wire bundles of various diameters therein.

2. The multiple diameter wire bundle support for fixedly retaining various numbers and diameters of wires in position on a subassembly structure defined in claim 1 wherein said first arm normally curves inwardly to form a spiral in the counterclockwise direction of relatively small diameter and said second arm normally curves less inwardly to form a relatively larger spiral in the clockwise direction around the outside of said first arm causing the inner surface of said first arm and the outer surface of said second arm to press against one another when said first arm is manually forced to form a larger spiral outside said second arm with said second arm forming a smaller spiral inside said first arm.

* * * * *